US007447464B2

(12) United States Patent
Miller

(10) Patent No.: US 7,447,464 B2
(45) Date of Patent: Nov. 4, 2008

(54) TONER CARTRIDGE HAVING A COLLAPSIBLE ACTUATING STRUCTURE

(75) Inventor: Steven Miller, Pinellas Park, FL (US)

(73) Assignee: Cartridge Corporation of America, Inc., Clearwater, FL (US)

( * ) Notice: Subject to any disclaimer, the term of this patent is extended or adjusted under 35 U.S.C. 154(b) by 90 days.

(21) Appl. No.: 11/279,819

(22) Filed: Apr. 14, 2006

(65) Prior Publication Data

US 2006/0153598 A1 Jul. 13, 2006

Related U.S. Application Data

(63) Continuation-in-part of application No. 10/742,323, filed on Dec. 19, 2003, now Pat. No. 7,136,608, and a continuation-in-part of application No. 10/907,470, filed on Apr. 1, 2005, now Pat. No. 7,177,567.

(51) Int. Cl.
*G03G 15/00* (2006.01)
*G03G 15/08* (2006.01)

(52) U.S. Cl. ..... 399/109; 399/13; 399/120

(58) Field of Classification Search ..... 399/13, 399/109, 119, 120, 258, 262
See application file for complete search history.

(56) References Cited

U.S. PATENT DOCUMENTS

| | | | | |
|---|---|---|---|---|
| 4,739,367 | A * | 4/1988 | Watanabe et al. | 399/111 |
| 4,949,983 | A * | 8/1990 | Miller | 277/505 |
| 5,365,315 | A * | 11/1994 | Baker et al. | 399/111 |
| 5,768,661 | A * | 6/1998 | Coffey et al. | 399/111 |
| 5,875,378 | A * | 2/1999 | Campbell et al. | 399/263 |
| 7,054,577 | B2 * | 5/2006 | Rogers et al. | 399/109 |

* cited by examiner

*Primary Examiner*—Sandra L Brase
(74) *Attorney, Agent, or Firm*—Thomas E. Toner; Smith & Hopen, P.A.

(57) ABSTRACT

An actuating structure formed in a toner cartridge adapted to actuate a physical sensor inside the printer which activates the printer when the door is closed. The actuating structure is displaced when the cartridge is inserted in printers that do not use a physical sensor in that location. Accordingly, the toner cartridge is functional in a plurality of printers. The toner cartridge can also have a plurality of actuating structures.

31 Claims, 6 Drawing Sheets

TONER CARTRIDGE HAVING A COLLAPSIBLE ACTUATING STRUCTURE

CROSS REFERENCE TO RELATED APPLICATIONS

This application is a continuation-in-part claiming the benefit of co-pending U.S. patent application Ser. No. 10/742,323 filed Dec. 19, 2003, and Ser. No. 10/907,470 filed Apr. 1, 2005, which are fully incorporated herein by reference.

BACKGROUND OF THE INVENTION

The present invention relates, generally, to a toner cartridge capable of use in a plurality of printers. Specifically, the present invention relates to an actuating structure capable of use in printers equipped with, and without, a micro-switch mechanism on the printer door.

Printer manufacturers such as IBM, Lexmark, and the like also make the toner cartridges that fit their respective printers. Each printer manufacturer designs its printers to accept toner cartridges manufactured by it and to reject the toner cartridges manufactured by others. Manufacturers have added structural features to the printers and to the toner cartridges that do not enhance the functional performance of the printer in any way but which serve to prevent use of a competitor's toner cartridge in the printer in order to increase sales. Printer manufacturers also prefer to sell new toner cartridges rather than replace empty toner cartridges. Therefore, they do not support the re-cycling industry. For example, printer cartridges constructed for LEXMARK T640 printers are adapted with an integrated actuating structure that interacts with a physical sensing switch in the printer to detect that a suitable cartridge has been installed.

SUMMARY OF INVENTION

A micro-switch actuating structure formed in a toner cartridge adapted to actuate a micro-switch inside the printer which activates the printer when the door is closed. The actuating structure is displaced when the cartridge is inserted in printers that do not use a physical sensor in that location. Accordingly, the toner cartridge is functional in a plurality of printers.

In one embodiment the actuating structure is formed on a resilient arm disposed in a wall of the waste bin. Once the cartridge is installed into the printer and the printer door is closed, the front angled surface of the actuating structure contacts and depresses a micro switch located in the printer. Once the micro switch in the printer is actuated, the printer determines that a cartridge is installed. When the cartridge is installed in a printer without a micro switch in this location, however, any obstruction in the printer which would prohibit installation of the cartridge, contacts the rounded edge of the front angled surface of the actuating structure and causes the resilient arm to deflect inward. The end result is that the actuating structure collapses into a side wall of the cartridge in order to allow the obstruction to pass the actuating structure. If the actuating structure were not collapsible, it would obstruct door closure in printers that do not use micro switches in that location.

In another embodiment, the actuating structure is formed with a notch. In this embodiment, the actuating structure can be "snapped off" when the cartridge is to be used in a printer without a micro switch. The actuating structure can be "snapped" back in for operation in a printer requiring activation of a micro switch.

In yet another embodiment, the actuating structure is formed from a pliable material. The actuating structure is sufficiently rigid to actuate a physical sensing switch in the printer. In contrast, the actuating structure is sufficiently resilient to be displaced when the cartridge is inserted in printers that do not use physical sensors in that location.

In another embodiment, the actuating structure is formed in a modular structure housing. The structure housing can be installed and removed onto either OEM or pre-existing toner cartridges, therefore supporting the recycling industry. The structure housing of this embodiment can be used in conjunction with any of the actuating structure embodiments discussed herein.

In another embodiment, the instant invention provides for a first actuating structure disposed to engage a physical sensor within the toner cartridge-receiving cavity of a printer belonging to a first family of printers. Additionally, a second actuating structure is disposed to engage a physical sensor within the toner cartridge-receiving cavity of a printer belonging to a second, that is different, family of printers. At least one actuating structure is a displaceable, or removable, actuating structure positioned to actuate a physical sensor adapted to activate said printer when the cartridge is inserted in said printer and the printer door is closed; and wherein said actuating structure is displaced when the cartridge is inserted in printers that do not use a physical sensor in that location as discussed above.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

A micro-switch actuating structure is formed in extending relation to the waste bin. In the examples provided herein the actuating structure extends from a top, side wall of the waste bin.

It is adapted to actuate a micro-switch inside the printer which activates the printer when the door is closed. The actuating structure has an extent sufficient to contact, and thereby, actuate the micro-switch when the door of the printer is closed.

This interaction of the printer and cartridge is generally known, as shown in U.S. Pat. No. 5,365,315 to Baker et al. and U.S. Pat. No. 5,758,233 to Coffey. Typically, however, the actuating structures of the prior art are integrally formed with the cartridge and are rigid. The rigidity of the structures prevent the use of the cartridge in differing printers since the actuating structure encounters physical obstructions in the varying printers. In this manner manufacturers have ensured that only their cartridges can be used in their printers and only their printers will accommodate their cartridges.

In one embodiment of the novel toner cartridge, the actuating structure is positioned to actuate a physical sensor adapted to activate the printer when the cartridge is inserted in a printer and the printer door is closed. The actuating structure is displaced, however, when the cartridge is inserted in printers that do not use a physical sensor in that location. Accordingly, the toner cartridge is functional in a plurality of printers.

Figure 1:
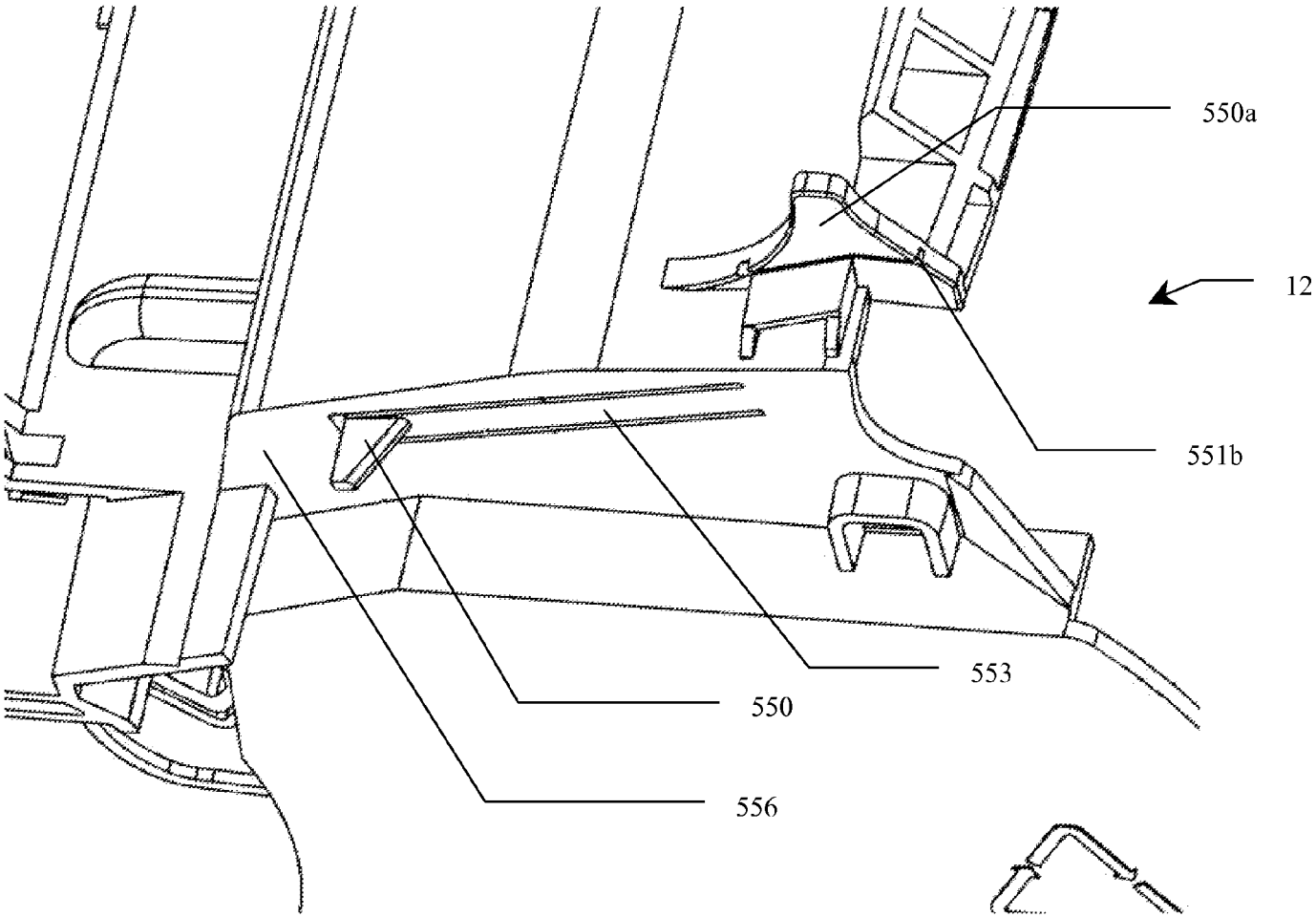
FIG. 1 is a side perspective view of a toner cartridge with the novel actuating structure, wherein the actuating structure is disposed on a resilient arm.

FIG. 1 depicts a first embodiment wherein the actuating structure is disposed on a resilient arm formed in a wall of said waste bin. The actuating structure can be mounted anywhere on the cartridge which corresponds to a switch in the printer, even though the examples herein depict the actuating structure as being placed on a top, side wall 556 of waste bin 12.

Figure 2:
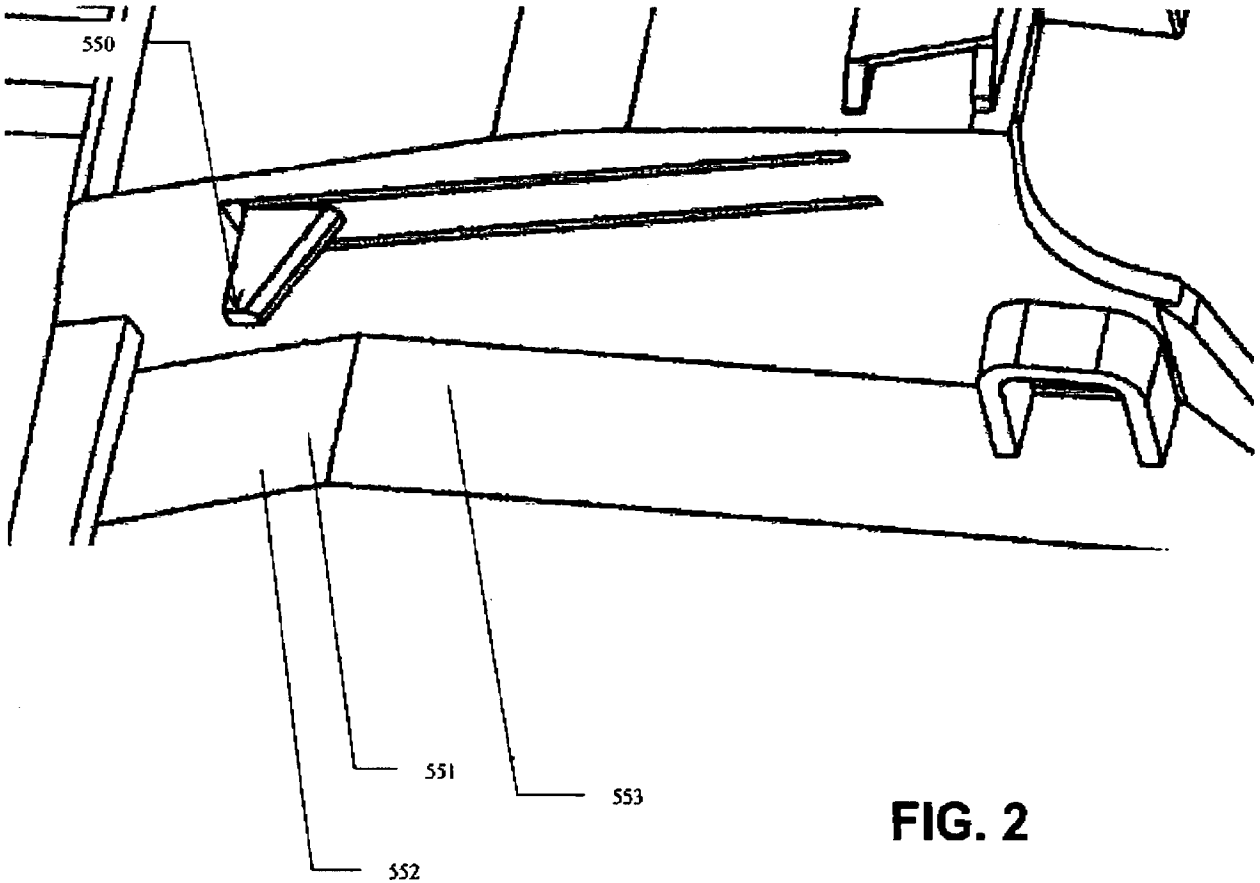
FIG. 2 is a detail view of the actuating structure and resilient arm.

Actuating structure 550 is positioned on resilient arm 553, that is to say that the arm is capable of returning to its original position, as after having been displaced. Actuating structure 550 is shown in greater detail in FIG. 2. Actuating structure further comprises, in various embodiments, front angled surface 551 and rounded edge 552. Although many shapes of the structure are contemplated, front angled surface 551 facilitates contact with, and depresses, the micro switch located on a hinge of the printer door. Once the micro switch on the printer door hinge is actuated, the printer determines that a cartridge is installed.

When the cartridge is installed in a printer without a micro switch on the printer door hinge the hinge of the printer door contacts rounded edge 552 which causes resilient arm 553 to deflect inward. The end result in this embodiment is that actuating structure 550 collapses into side wall 556 of waste bin 12 in order to allow the printer door hinge to pass actuating structure 550 so that the printer door can close. If actuating structure 550 were not collapsible, as in the prior art, it would obstruct door closure in printers that do not use micro switches in that location.

Figure 3:
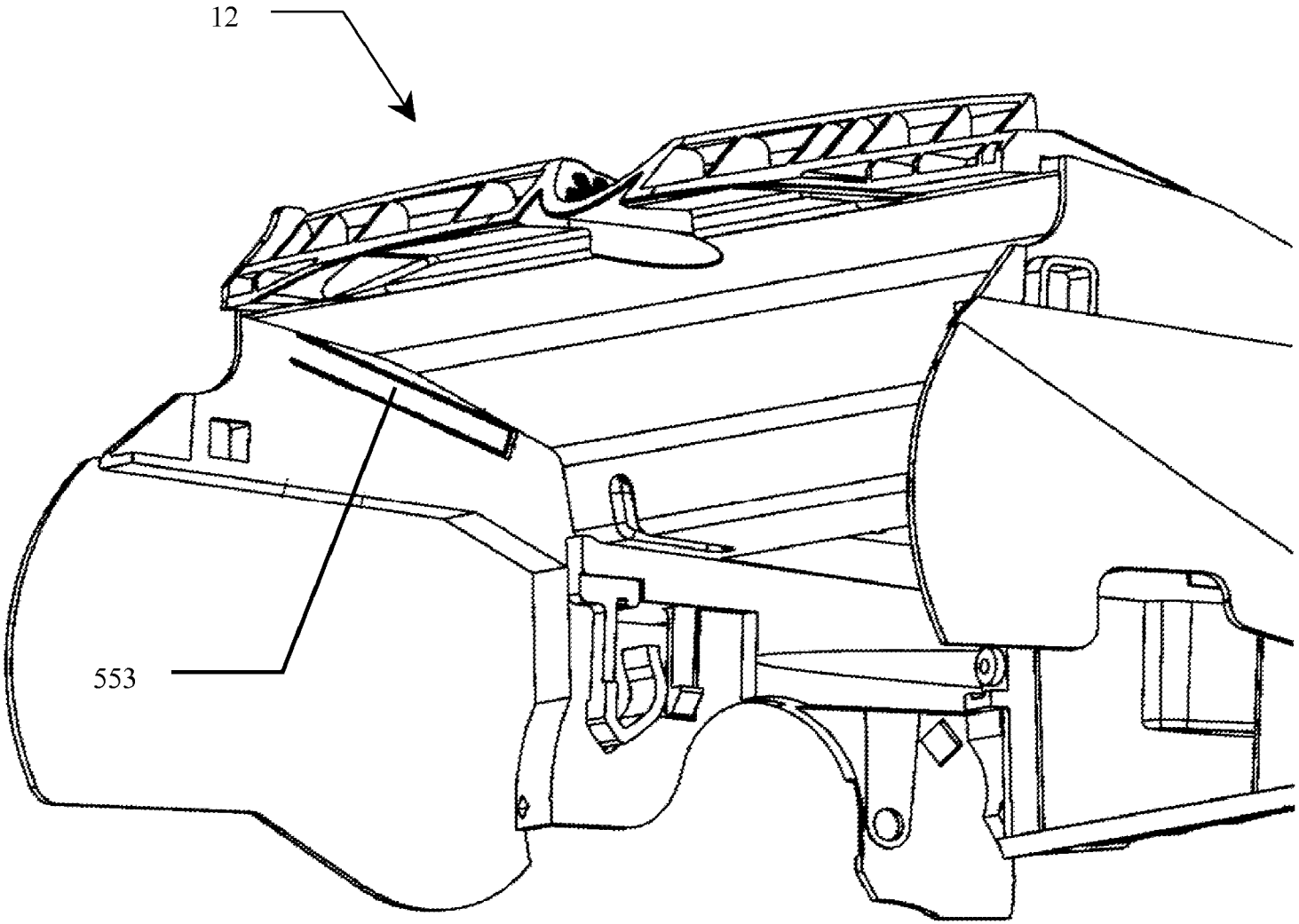
FIG. 3 is a rear perspective view of the toner cartridge, wherein the hopper has been removed.

FIG. 3 represents an alternate view wherein the hopper is removed. This perspective provides a better view of how actuating structure 550 and resilient arm 553 are displaced within sidewall 556 when installed in a printer with a micro-switch on the printer door hinge.

Figure 4:
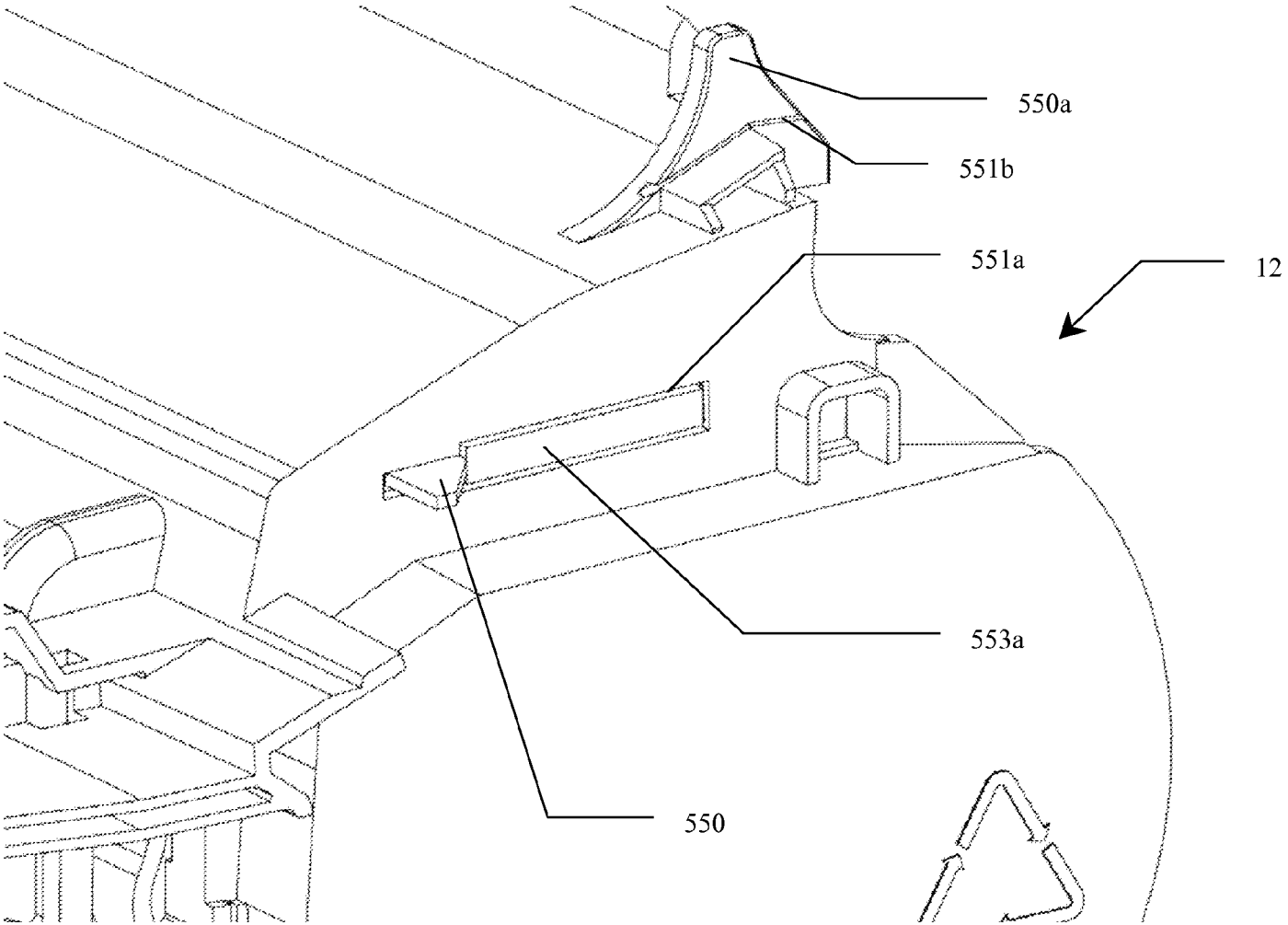
FIG. 4 is a side perspective view of a toner cartridge with the novel actuating structure, wherein the actuating structure is disposed on a removable arm.

A second embodiment is shown in FIG. 4. Here, resilient arm 553 of the previous embodiment is replaced with removable arm 553*a*. Removable arm 553*a* can either be formed as part of the cartridge such that it can be "snapped off" when the cartridge is to be used in a printer without a micro-switch on the printer door hinge. Removal of arm 553*a* is facilitated by groove 551*a* formed around at a part of the perimeter of arm 553*a*. In a preferred embodiment, however, removable arm 553*a* can be removed and then reinserted, "snapped back," into the cartridge as conditions and intended use of the cartridge dictate.

In yet another embodiment, the actuating structure is formed of a resilient material. In this manner the structure can be affixed directly to the cartridge. The actuating structure of this embodiment is formed of a pliable material. The material should have sufficient rigidity to actuate a physical sensing switch in the printer. In contrast, the pliable material needs to be sufficiently resilient to be displaced when the cartridge is inserted in printers that do not use physical sensors in that location.

Figure 5:
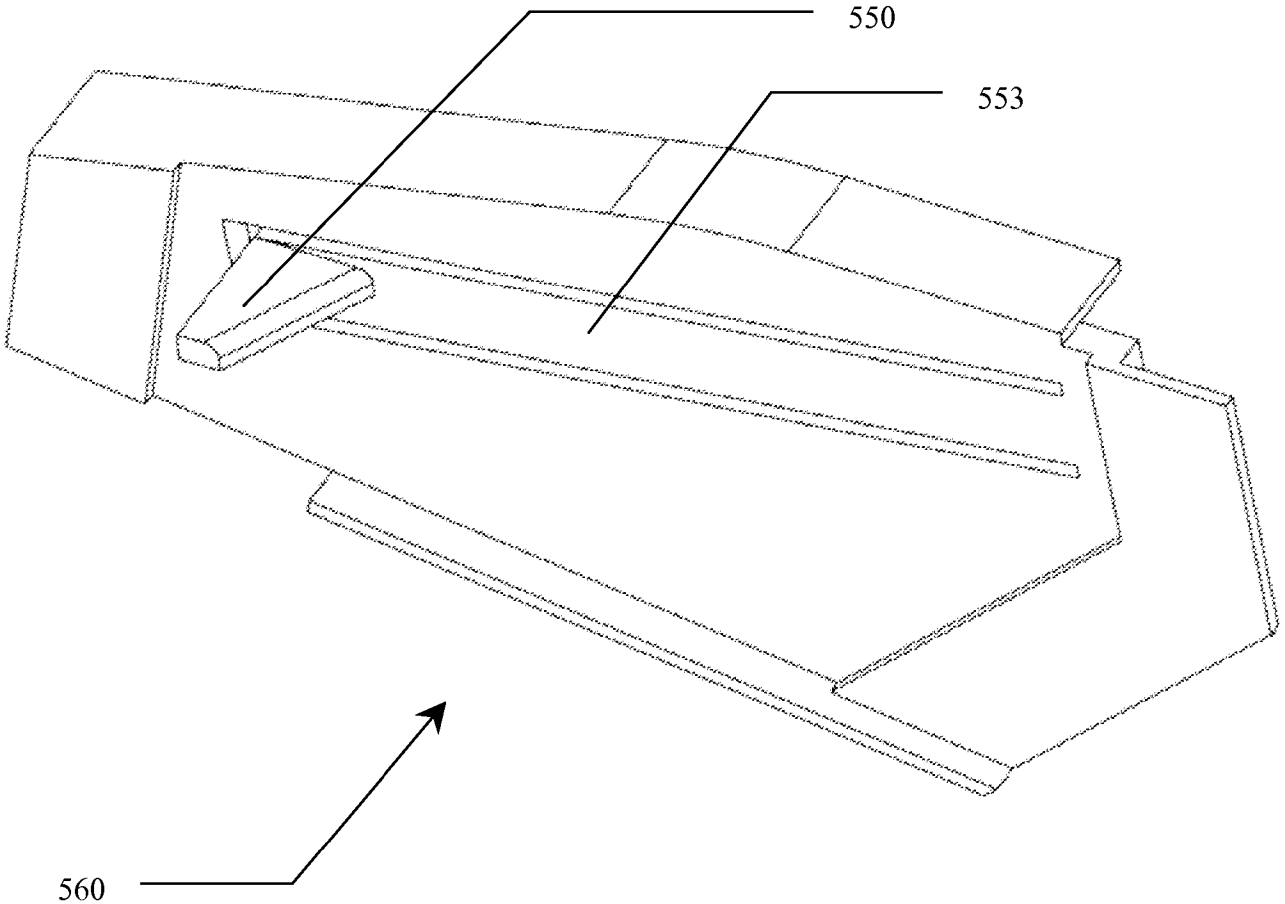
FIG. 5 is a perspective view of the structure housing.
Figure 6:
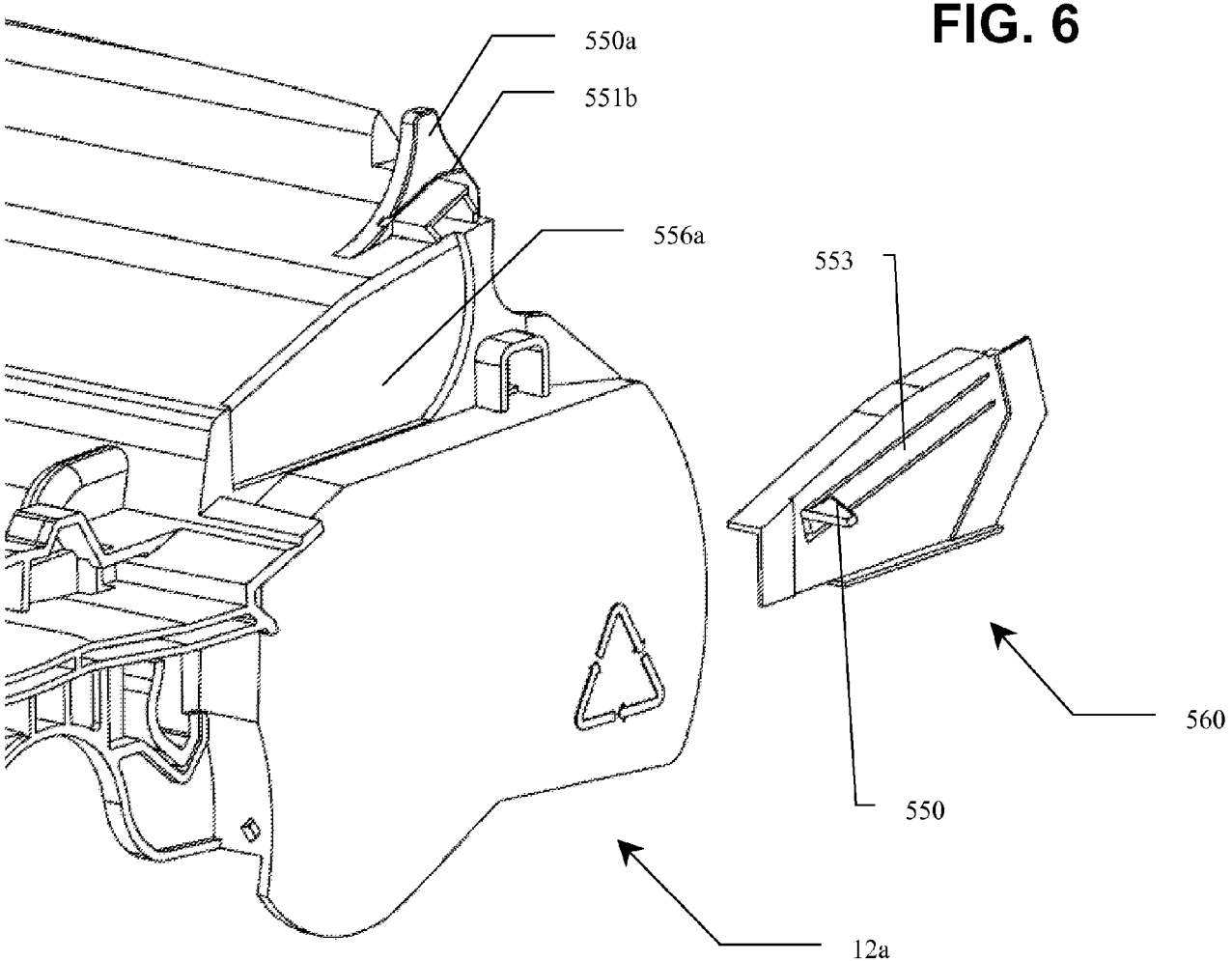
FIG. 6 is a semi-exploded view showing the relation of the structure housing to the toner cartridge.

Another embodiment is shown in FIGS. 5 and 6. This embodiment allows the altering of a previously constructed cartridge to work in the same manner as the embodiments discussed above. In this embodiment, a pre-existing cartridge 12*a* (FIG. 6) is equipped with structure housing 560. Housing 560 is seen in FIGS. 5 and 6 as adapted to mount over hole 556*a* in sidewall 556 of pre-existing cartridge 12*a*. Housing 560 may take many shapes, however, since actuating structure 550 can be used anywhere on the cartridge.

Housing 560 is adapted to hold actuating structure 550 in all its previously discussed embodiments. Housing 560 can accommodate both resilient arm 553 and removable arm 553*a*. This embodiment differs in very few respects from those above with the obvious exception of its ability to adapt previously constructed cartridges, and the fact that in embodiments incorporating resilient arm 553, actuating structure 550 is displaced into housing 560.

Housing 560 can also be incorporated in original equipment manufacturer cartridges in addition to use on pre-existing cartridges. In such an embodiment, housing 560 can be removed and reinstalled on the cartridge to best match the cartridges intended use.

It is also envisioned that a plurality of actuating structures can be incorporated into a single toner cartridge, since it may not always be possible to provide operability in all desired printers with the placement of a single structure. Referring again to FIGS. 1, 4 and 6, moveable actuating structure 550, in its respective forms, is combined with a second actuating structure 550*a*. Although the embodiment of FIG. 4 shows a moveable actuating structure in combination with a static actuating, it is also envisioned that a plurality of moveable actuating structures can be used. It may therefore be desirable to combine the moveable actuating structure of FIG. 4, wherein the actuating structure is removable, with the displaceable actuating structure of FIG. 2. It will be clear that any combination, or number, of such actuating structures are contemplated.

An alternative embodiment is shown in FIGS. 1, 4 and 6 which allows second actuating structure 550*a* to be removed. Here, groove 551*b* is formed where actuating structure 550*a* attaches to the cartridge, such that actuating structure 550*a* can be "snapped off" when the cartridge is to be used in a printer without a micro-switch on the printer door.

Accordingly, the instant invention provides for a first actuating structure disposed to engage a physical sensor within the toner cartridge-receiving cavity of a printer belonging to a first family of printers. Additionally, a second actuating structure is disposed to engage a physical sensor within the toner cartridge-receiving cavity of a printer belonging to a second, that is different, family of printers. At least actuating structure is a displaceable actuating structure positioned to actuate a physical sensor adapted to activate said printer when the cartridge is inserted in said printer and the printer door is closed; and wherein said actuating structure is displaced when the cartridge is inserted in printers that do not use a physical sensor in that location as discussed above.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A toner cartridge adapted to fit within a toner cartridge-receiving cavity of a printer, comprising:

a waste bin;

a hopper; and a displaceable actuating structure positioned to actuate a physical sensor adapted to activate said printer when the cartridge is inserted in said printer and the printer door is closed;

wherein said actuating structure is displaced when the cartridge is inserted in printers that do not use a physical sensor in that location.

2. The toner cartridge of claim 1 further comprising a resilient arm formed in a wall of said waste bin.

3. The toner cartridge of claim 2 wherein the actuating structure is disposed on said resilient arm such that the actuating structure is displaced into said wall of said waste bin when the cartridge is inserted in printers that do not use a physical sensor in that location.

4. The toner cartridge of claim 2 wherein the resilient arm is integrally formed in a wall of said waste bin.

5. The toner cartridge of claim 1 wherein the front edge of the actuating structure is angled.

6. The toner cartridge of claim 1 wherein the actuating structure is formed of a pliable material, said material having sufficient rigidity to actuate a physical sensing switch in said printer.

7. The toner cartridge of claim 6 wherein said pliable material is sufficiently resilient to be displaced when the cartridge is inserted in printers that do not use a physical sensor in that location.

8. A toner cartridge adapted to fit within a toner cartridge-receiving cavity of a printer, comprising:

a waste bin;

a hopper;

a structure housing attached to a wall of said waste bin; and a displaceable actuating structure positioned on said structure housing to actuate a physical sensor adapted to activate said printer when the cartridge is inserted in said printer and the printer door is closed;

wherein said actuating structure is displaced when the cartridge is inserted in printers that do not use physical sensors in that location.

9. The toner cartridge of claim 8 further comprising a resilient arm formed in a wall of said structure housing.

10. The toner cartridge of claim 9 wherein the actuating structure is disposed on said resilient arm such that the actuating structure is displaced into said structure housing when the cartridge is inserted in printers that do not use a physical sensor in that location.

11. The toner cartridge of claim 9 wherein the resilient arm is integrally formed in said structure housing.

12. The toner cartridge of claim 8 wherein the front edge of the actuating structure is angled.

13. The toner cartridge of claim 8 wherein the actuating structure is formed of a pliable material, said material having sufficient rigidity to actuate a physical sensing switch in said printer.

14. The toner cartridge of claim 8 wherein said pliable material is sufficiently resilient to be displaced when the cartridge is inserted in printers that do not use a physical sensor in that location.

15. A toner cartridge adapted to fit within a toner cartridge-receiving cavity of a printer, comprising:

a waste bin;

a hopper;

a first actuating structure disposed to engage a physical sensor within the toner cartridge-receiving cavity of a printer belonging to a first family of printers;

a second actuating structure disposed to engage a physical sensor within the toner cartridge-receiving cavity of a printer belonging to a second family of printers.

16. The toner cartridge of claim 15 wherein at least one actuating structure is a displaceable actuating structure positioned to actuate a physical sensor adapted to activate said printer when the cartridge is inserted in said printer; and wherein said actuating structure is displaced when the cartridge is inserted in a printer that does not use a physical sensor in that location.

17. The toner cartridge of claim 16 further comprising a resilient arm formed in a wall of said waste bin.

18. The toner cartridge of claim 17 wherein the actuating structure is disposed on said resilient arm such that the actuating structure is displaced into said wall of said waste bin when the cartridge is inserted in printers that do not use a physical sensor in that location.

19. The toner cartridge of claim 17 wherein the resilient arm is integrally formed in a wall of said waste bin.

20. The toner cartridge of claim 16 wherein the actuating structure is formed of a pliable material, said material having sufficient rigidity to actuate a physical sensing switch in said printer.

21. The toner cartridge of claim 20 wherein said pliable material is sufficiently resilient to be displaced when the cartridge is inserted in printers that do not use a physical sensor in that location.

22. The toner cartridge of claim 15 wherein at least one actuating structure is removable.

23. The toner cartridge of claim 22 wherein at least one actuating structure is removably formed in a wall of said waste bin.

24. The toner cartridge of claim 23 wherein the actuating structure is such that the actuating structure is removed from said wall of said waste bin when the cartridge is inserted in printers that do not use a physical sensor in that location.

25. The toner cartridge of claim 23 wherein the actuating structure is integrally formed in a wall of said waste bin.

26. The toner cartridge of claim 15 wherein at least one actuating structure comprises a structure housing attached to a wall of said waste bin; and a displaceable actuating structure positioned on said structure housing to actuate a physical sensor adapted to activate said printer when the cartridge is inserted in said printer and the printer door is closed.

27. The toner cartridge of claim 26 further comprising a resilient arm formed in a wall of said structure housing.

28. The toner cartridge of claim 27 wherein the actuating structure is disposed on said resilient arm such that the actuating structure is displaced into said structure housing when the cartridge is inserted in printers that do not use a physical sensor in that location.

29. The toner cartridge of claim 27 wherein the resilient arm is integrally formed in said structure housing.

30. The toner cartridge of claim 26 wherein the actuating structure is formed of a pliable material, said material having sufficient rigidity to actuate a physical sensing switch in said printer.

31. The toner cartridge of claim 30 wherein said pliable material is sufficiently resilient to be displaced when the cartridge is inserted in printers that do not use a physical sensor in that location.

* * * * *